US006219982B1

(12) United States Patent
Eyring

(10) Patent No.: US 6,219,982 B1
(45) Date of Patent: Apr. 24, 2001

(54) JOINT COVER AND SEALING DEVICE FOR CONCRETE PANELS

(75) Inventor: Kurt S. Eyring, Dayton, OH (US)

(73) Assignee: Miller-Valentine Construction Inc., Dayton, OH (US)

( * ) Notice: Subject to any disclaimer, the term of this patent is extended or adjusted under 35 U.S.C. 154(b) by 0 days.

(21) Appl. No.: 09/502,253

(22) Filed: Feb. 17, 2000

Related U.S. Application Data

(63) Continuation of application No. 09/059,518, filed on Apr. 13, 1998.

(51) Int. Cl.[7] ..... E04B 1/684

(52) U.S. Cl. ..... 52/396.04; 52/396.05; 52/396.08; 52/393; 52/394; 52/468; 52/471

(58) Field of Search ..... 52/396.04, 312, 52/396.05, 396.07, 396.08, 393, 394, 468, 469, 471, 802.1, 716.02, 716.6, 716.7, 717.03, 717.05, 718.06, 718.03; 404/47, 64, 65

(56) References Cited

U.S. PATENT DOCUMENTS

| | | | | |
|---|---|---|---|---|
| 2,230,688 | | 2/1941 | Irwin . | |
| 3,039,232 | | 6/1962 | Dunn . | |
| 3,213,584 | * | 10/1965 | Bush | 52/396.08 X |
| 3,760,544 | | 9/1973 | Hawes et al. . | |
| 4,067,155 | | 1/1978 | Ruff et al. . | |
| 4,438,609 | | 3/1984 | Nielson et al. . | |
| 4,533,278 | * | 8/1985 | Corsover et al. | 404/65 |
| 5,155,952 | | 10/1992 | Herwegh et al. . | |
| 5,197,250 | * | 3/1993 | Kramer | 52/396 |
| 5,343,662 | * | 9/1994 | Nelson | 52/208 |

* cited by examiner

*Primary Examiner*—Carl D. Friedman
*Assistant Examiner*—Phi Dieu Tran A
(74) *Attorney, Agent, or Firm*—Jacox, Meckstroth & Jenkins

(57) ABSTRACT

Variable gaps between adjacent concrete panels are covered and sealed by a T-shaped body of extruded semi-rigid plastics material and which includes a one piece cover section and stem section of generally uniform wall thickness. The stem section has a set of parallel spaced flexible fins projecting from each side at an angle of 45° towards the cover section, and the fins increase in width from the distal end of the stem section towards the cover section. Each fin has parallel spaced triangular gripping ribs on its side facing away from the cover section for gripping opposing concrete surfaces defining gaps ranging generally from ½" to 1¼". In one embodiment, the cover section has a slightly crowned intermediate portion with tapered opposite edge portions, and in other embodiments, the intermediate portion is curved or configured to cover gaps defined within outside and inside corners formed by adjacent panels.

8 Claims, 2 Drawing Sheets

JOINT COVER AND SEALING DEVICE FOR CONCRETE PANELS

RELATED APPLICATION

This application is a continuation of application Ser. No. 09/059,518, filed Apr. 13, 1998.

BACKGROUND OF THE INVENTION

In the construction of buildings with precast concrete panels, it is common to form or cast tilt-up concrete wall panels on a preformed concrete floor slab and then tilt the wall panels to upright vertical positions. Usually, the adjacent wall panels have gaps between the opposing edge surfaces of the panels, and the gaps may range from ½" to 1¼". The gaps are usually filled from the exterior side of the wall with a resilient rod and a sealant material which bonds to the rod and the edge surfaces of the concrete panels and provides for the necessary expansion and contraction of the panels. When the inner surfaces of the concrete wall panels are exposed, for example, in a factory or warehouse, it is desirable to cover the exposed joints or gaps between the wall panels to provide the wall with a more attractive inside appearance.

There have been a number of systems either proposed or used for covering and sealing the joints or gaps between structural panels of concrete and other materials, such as the joints between vertical wall panels or the joints between horizontal floor or deck panels. For example, U.S. Pat. No. 3,760,544 and No. 4,067,155 disclose joint sealing systems for wall panels and which include generally T-shaped sealing gaskets or members having multiple teeth or wings. The teeth or wings engage serrations within extruded members forming the opposing edge surfaces of the panels or within an opposing a joint member inserted into the gap from the opposite sides of the panels. U.S. Pat. No. 4,533,278 and No. 5,197,250 disclose expansion joint systems for use between horizontal concrete panels or slabs which form a horizontal surface or deck.

In any joint cover and sealing system for use with precast concrete panels, which may or may not have internal insulation layers, it is desirable for the joint cover to form a positive and dependable joint connection and cover which can accommodate a wide variety of gap profiles, for example, ranging from ½" to 1¼", and to be installed without any special edge preparation of the concrete panels. It is also desirable for the joint cover to be self-centering within gaps which are not perfectly linear and to provide for positively gripping the concrete edge surfaces of the panels. It is further desirable for the joint cover to be of economical construction and to be easily and quickly installed.

SUMMARY OF THE INVENTION

The present invention is directed to an improved joint cover and sealing device for use between structural panels and which is ideally suited for sealing and covering the joints or gaps between precast concrete wall panels which are tilted up from horizontal positions where the concrete panels are poured and cured. The joint cover of the invention provides all of the desirable features mentioned above, and more specifically, is durable and inexpensive in construction, may be used with a wide range of gap profiles, provides for positive gripping the concrete panels, may be conveniently cut to length and extruded in a variety of colors, and may also be used for inside and outside corner joints.

In accordance with preferred embodiments of the invention, a joint cover device comprises a one piece elongated body of extruded semi-rigid plastics material and including a longitudinally extending cover section and a longitudinally extending stem section with both sections having a generally uniform wall thickness. The stem section has a flat center wall with a plurality of longitudinally extending and generally parallel spaced flexible fins which project from opposite sides of the center wall towards the cover section, and the width of the fins gradually decreases towards the distal end of the stem section. Each of the fins has a plurality of parallel spaced gripping ribs on the surface facing away from the cover section for gripping the opposing edge surfaces of the concrete panels. The cover section is slightly crowned or angular or curved inwardly and has opposite tapering edge portions which engage the adjacent interior side surfaces of the concrete panels.

Other features and advantages of the invention will be apparent from the following description, the accompanying drawings and the appended claims.

DESCRIPTION OF THE PREFERRED EMBODIMENTS

Figure 1:
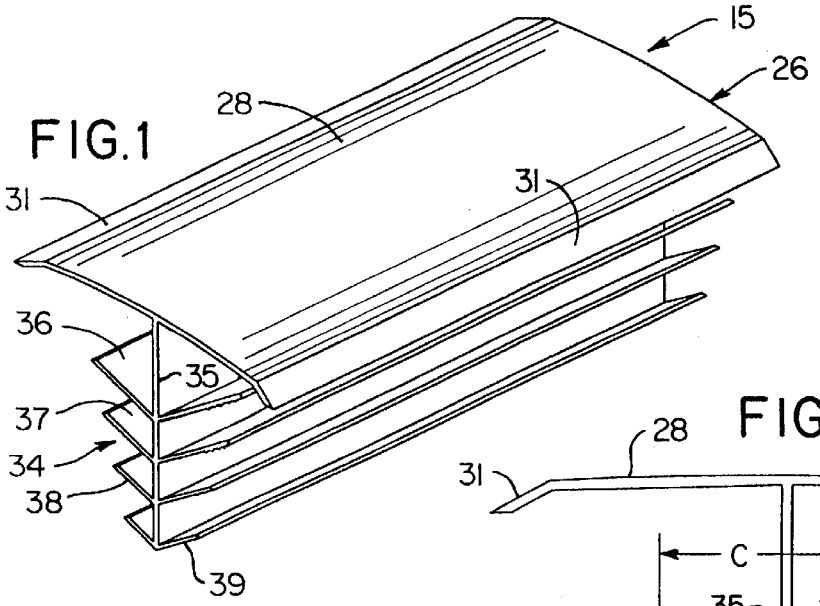
FIG. 1 is a perspective view of a short length of a joint cover and sealing device constructed in accordance with the invention.
Figure 2:
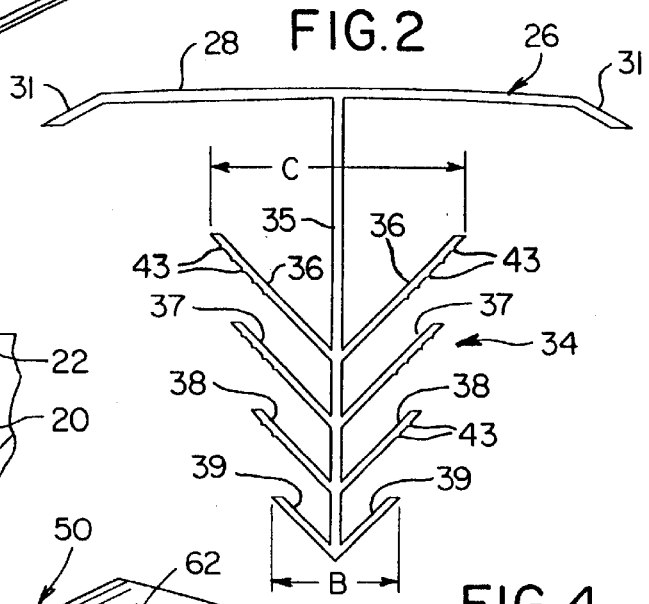
FIG. 2 is a full size end view of the cover device shown in FIG. 1.
Figure 3:
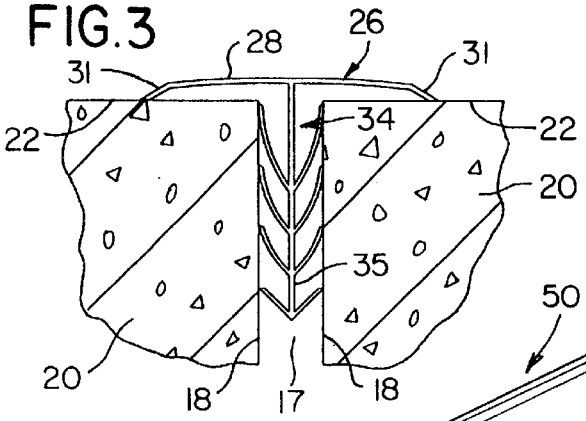
FIG. 3 is a reduced end view of the cover device and shown installed within a gap between two adjacent concrete panels.

A joint cover and sealing device 15 is shown in FIGS. 1–3 for covering a gap 17 defined between generally parallel surfaces 18 of two concrete wall panels 20 each having an interior surface 22. The actual size of one cover device 15 is shown in FIG. 2 and includes a one-piece body of extruded semi-rigid plastics material such as polyvinylchloride (PVC). The device 15 includes a generally flat cover section 26 having an intermediate portion 28 integrally connecting opposite tapered edge portions 31. The intermediate portion has a slight crown configuration with a radius of about 10.5 inches, and each of the edge portions 31 forms an obtuse angle of about 150° with the intermediate portion 28. 50 includes a cover section 62 formed by a generally flat center portion 64, opposite edge portions 66 and right angular wall portions 68 integrally connecting the center portion 64 to the edge portions 66. The angular wall portions 68 extend generally parallel to the corresponding concrete panel surfaces 59, and the edge portions 66 taper inwardly from the wall portions 68 on an angle of about 30° to engage the outer surfaces 59. The cover device 50 also includes a stem portion 34 which is extruded as an integral part of the cover device and is constructed the same as the stem portion 34 described above in connection with FIGS. 1–3 and accordingly, carries the same reference numbers.

Figure 7:
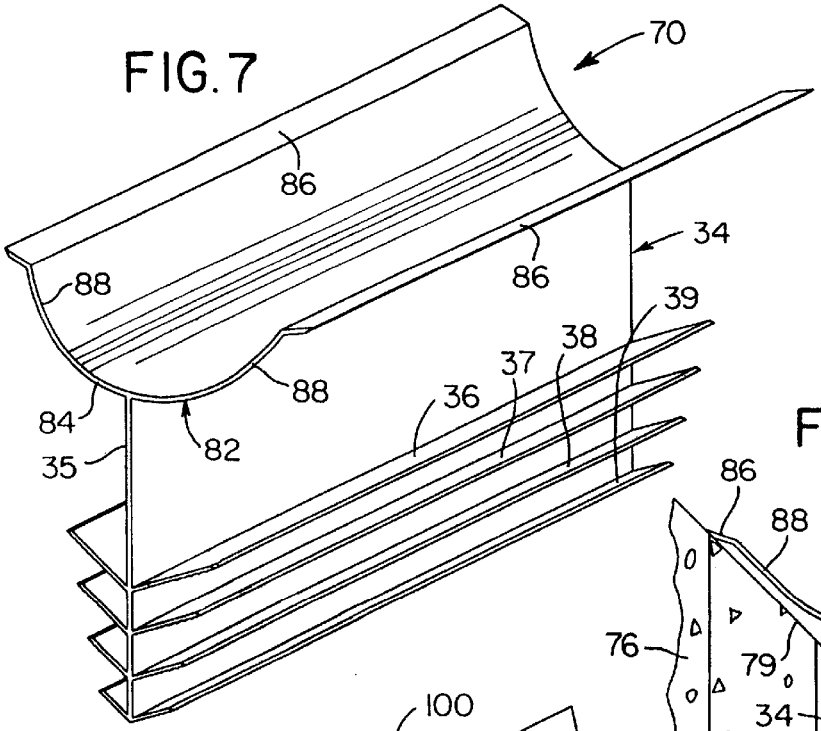
FIGS. 7 & 8 are views similar to FIGS. 1 & 3 of a joint cover device constructed in accordance with another embodiment of the invention for an inside corner.
Figure 8:
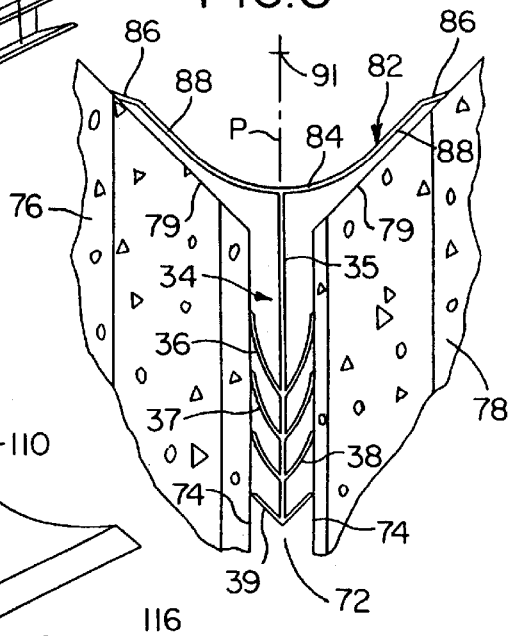

Referring to FIGS. 7 and 8, a joint cover and ceiling device 70 is constructed in accordance with another embodiment of the invention for covering and sealing a joint or gap 72 defined between parallel end surfaces 74 of two concrete wall panels 76 and 78 having corresponding interior surfaces 79 forming an inside vertical corner between the concrete panels. The cover device 70 is extruded with a cover section 82 including an intermediate portion with a uniformly curved center portion 84 and tapered opposite edge portions 86 connected to the center portion 84 by flat wall portions 88 extending generally parallel to the panel surfaces 79. The cover device 70 also includes a stem section 34 which is extruded integrally with the cover section 82 and is identified with the same reference numbers used above for the stem section 34. As shown in FIG. 8, the center of wall 35 of the stem section 34 extends within a plane P which passes through the center of curvature 91 for the curved center wall portion 84.

Figure 9:
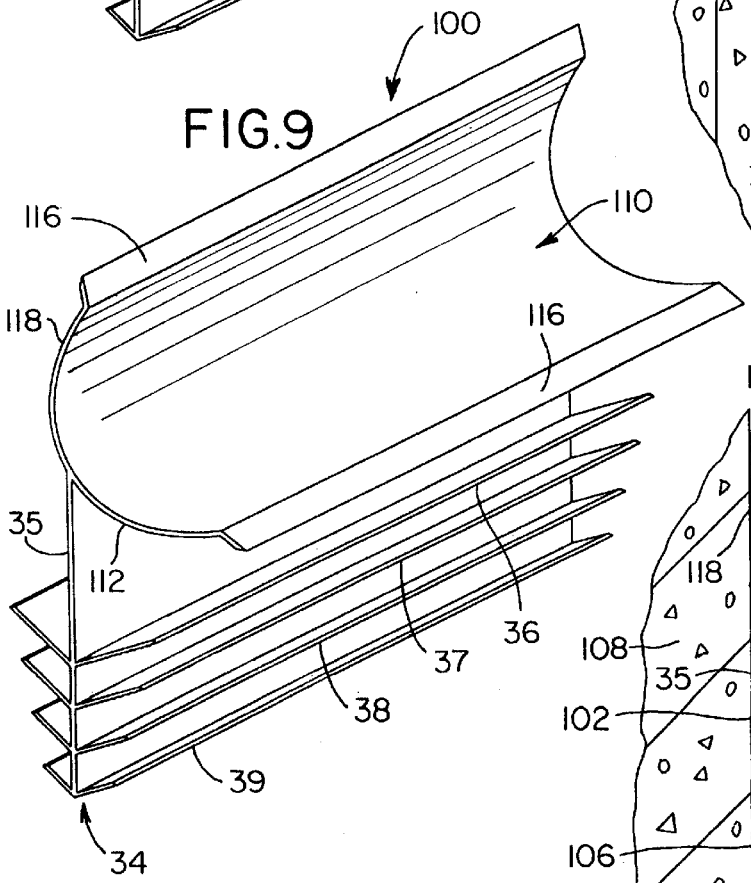
FIGS. 9 & 10 are views similar to FIGS. 7 & 8 of a joint cover device constructed in accordance with a further embodiment of the invention, also for use with an inside corner joint.
Figure 10:
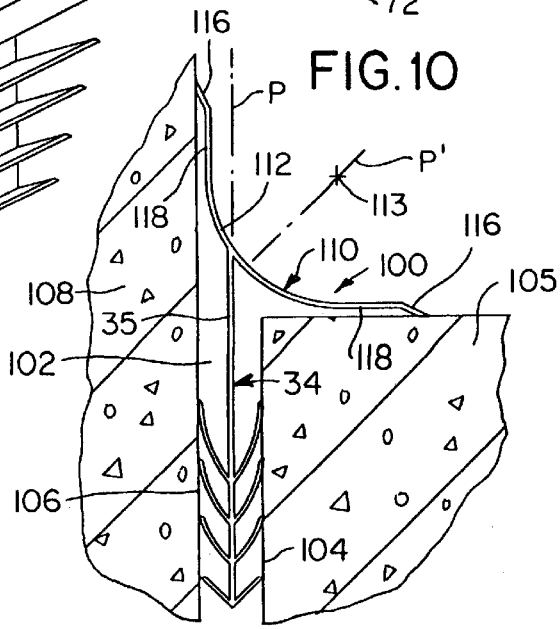

FIGS. 9 and 10 illustrate another form or modification of a joint cover device 100 constructed in accordance with the invention for covering and sealing a joint gap 102 defined between an end surface 104 of a concrete panel 105 and a side surface 106 of a concrete panel 108. In a typical building structure, the panel 108 might be an outside concrete wall panel, and the panel 105 might be an inside wall panel or a floor panel. The panels 102 and 105 define an inside corner joint having the gap 102 which is covered by an integrally extruded cover section 110. The section 110 has a uniformly curved center wall portion 112 with a center of curvature 113. Opposite tapered edge portions 116 are integrally connected to the center wall portion 112 by corresponding flat wall portions 118 extending generally parallel to the adjacent surfaces of the concrete panels 105 and 108.

As apparent from FIG. 10, the cover device 100 also includes a stem section 34 extruded integrally with the cover section 110 and having the same construction as the stem section 34 described above. As also apparent from FIG. 10, the center wall 35 of the stem section 34 extends within the plane P which is generally parallel to the flat wall portion 118 of the cover section 110 and the concrete panel surface 106. The plane P forms an acute angle of about 60 with a plane P' defined by the center of curvature 113 and the intersection of the wall portions 35 and 112.

From the drawings and above description, it is apparent that a joint cover device constructed in accordance with the present invention, provides desirable features and advantages. For example, the cover device is ideally suited for use with joints between precast concrete panels and which frequently define gaps with substantial variation in width. The device requires no special preparation of the opposing concrete surfaces defining the gap and positively grips the surfaces to assure that the device remains in place, especially over a period of years with thermal expansion and contraction of the concrete panels. The device of the invention also effectively seals against the flow of air through the joint or gap and may be conveniently extruded in different shapes for covering inside and outside corner joints as well as joints between in-line concrete panels.

In addition, the cover device of the invention is self-centering within the gap, may be easily cut to length during installation, is easily and quickly installed, and may be extruded in a variety of colors according to the color of the inside surfaces of the concrete panels. The arrangement and position of the fins 36–39 on each stem section 34 and the sharp ribs 43 provide for positively gripping the concrete surfaces defining a variety of gap profiles, and the flexibility of the stem wall 35 and the fins 36–39 provides for using the device in covering gaps which are not perfectly linear and/or change in width along the length of the joint.

While the forms of joint covering device herein described constitute preferred embodiments of the invention, it is to be understood that the invention is not limited to these precise forms of device, and that changes may be made therein without departing from the scope and spirit of the invention as defined in the appended claims.

What is claimed is:

1. In combination with two concrete panels having adjacent side surfaces extending from generally parallel spaced opposing surfaces defining an elongated gap therebetween, a joint device covering and sealing said gap, comprising a one-piece elongated solid body of extruded semi-rigid plastics material, said body including a longitudinally extending cover section having a generally uniform solid wall thickness and opposite edge portions, said cover section covering said gap with said opposite edge portions of said cover section engaging said adjacent side surfaces of said concrete panels, said body further including a longitudinally extending stem section projecting into said gap from an intermediate portion of said cover section and having a single solid center wall with opposite sides defining a substantially uniform centerwall thickness, a plurality of at least three longitudinally extending and generally parallel spaced flexible gripping fins projecting at an inclined acute angle from each of said opposite sides of said center wall towards said cover section and engaging said opposing surfaces of said concrete panels, each of said fins having a substantially uniform wall thickness and a width substantially greater than the thickness of said center wall, the combined width of said center wall and said gripping fins engaging said opposing surfaces of said concrete panels adjacent said cover section being substantially greater than the combined width of said center wall and said gripping fins engaging said opposing surfaces of said concrete panels at a distal end of said stem section, and said fins are effective to flex and grip said opposing surfaces of said concrete panels when said gap has substantial variation in width for holding said cover section firmly against said side surfaces of said concrete panels continuously along said gap.

2. A device as defined in claim 1 wherein at least one of said fins on each said side of said center wall of said stem section includes a plurality of parallel spaced gripping ribs on a surface facing away from said cover section.

3. A device as defined in claim 1 wherein said intermediate portion of said cover section includes longitudinally extending and generally flat wall portions integrally connecting said edge portions to a generally flat center portion of said cover section, and each of said generally flat wall portions forms an obtuse angle with said center portion and an obtuse angle with the corresponding said edge portion.

4. A device as defined in claim 1 wherein said intermediate portion of said cover section curves inwardly towards said stem section, and said stem section extends in a plane passing generally through the center of curvature of said intermediate portion for covering a gap defined between panels at an inside corner.

5. A device as defined in claim 1 wherein each of said fins includes a plurality of parallel spaced gripping ribs on a surface facing away from said cover section.

6. A device as defined in claim 1 wherein said combined width of said fins and said center wall of said stem section progressively increases from about 11/16 inch at said distal end of said stem section to about 1 3/8 inches adjacent said cover section.

7. A device as defined in claim 1 wherein the width of the widest said fin on each said side of said center wall of said stem section is about twice the width of the narrowest said fin on said center wall.

8. A device as defined in claim 1 wherein a plurality of said fins on each said side of said center wall of said stem section includes a plurality of parallel spaced gripping ribs on a surface facing away from said cover section.

* * * * *

UNITED STATES PATENT AND TRADEMARK OFFICE

CERTIFICATE OF CORRECTION

PATENT NO. : 6,219,982 B1
DATED : April 24, 2001
INVENTOR(S) : Kurt S. Eyring

Figure 4:
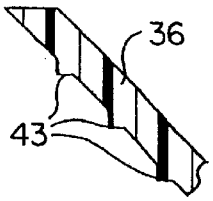
FIG. 4 is an enlarged fragmentary section of a typical flexible fin on the cover device shown in FIGS. 1–3.

It is certified that error appears in the above-identified patent and that said Letters Patent is hereby corrected as shown below:

Column 2,
Line 59, after 28, insert following page 4:

A stem section 34 includes a generally flat center wall 35 which extends perpendicular from the center of the intermediate portion 28 of the cover section 26, and the wall 35 and the section 26 each have a generally uniform wall thickness of about .060 inch. The stem section 34 includes a set of four generally flat fins 36-39 which project from each side of the center wall 35 towards the cover section 26 at an angle of about 45°. Each of the fins 36-39 is flexible and has a plurality of parallel spaced right angle gripping ribs 43 (FIG. 4) formed on the outer side of each fin facing away from the cover section 26.

The combined width of the center wall 35 and each pair of fins 34-36 increases from the fins 39 at the distal end of the stem section 34 to the fins 36 adjacent the cover section 26. Preferably, the combined width progressively increases from a width B of about 11/16 inch to a width C of about 1 3/8 inches. This variable width of the combined pairs of fins 36-39 has been found ideally suited for use with a gap 17 which typically may vary from 1/2 inch to 1 1/4 inch. The base thickness of each fin 36-39 is about .045 inch, and the ribs 43 are each formed by converging right angle surfaces each having a width of about .020 inch.

As apparent from FIG. 3, when a cover device 15 is inserted into a gap 17, at least some of the angularly projecting fins 36-39 flex so that the parallel spaced sharp ribs 43 engage and grip the opposing edge surfaces 18 of the wall panels 20. Also, when the stem section 34 of the cover device 15 is pressed into the gap 17, sometimes with the aid of a rubber mallet, the tapered edge portions 31 of the cover section 26 firmly engage the interior vertical surfaces 22 of the wall panels 20. This engagement cooperates with the engagement of the ribs 43 against the surfaces 18 to provide a generally fluid-tight seal for the joint or gap 17.

UNITED STATES PATENT AND TRADEMARK OFFICE

CERTIFICATE OF CORRECTION

PATENT NO. : 6,219,982 B1
DATED : April 24, 2001
INVENTOR(S) : Kurt S. Eyring

Figure 5:
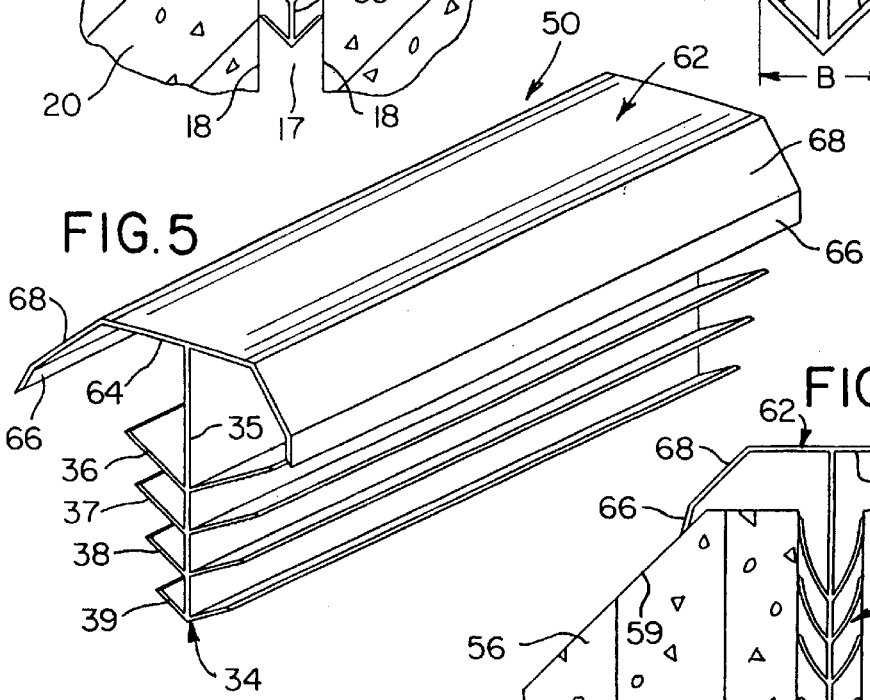
FIGS. 5 & 6 are views similar to FIGS. 1 & 3 of a cover device constructed in accordance with a modification of the invention for an outside corner.
Figure 6:
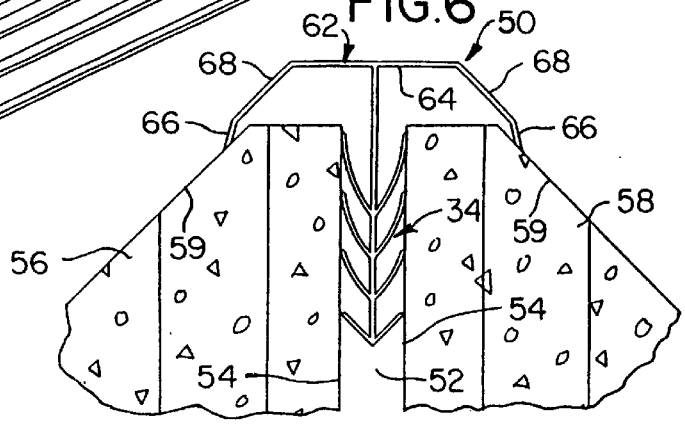

It is certified that error appears in the above-identified patent and that said Letters Patent is hereby corrected as shown below:

Referring to FIGS. 5 and 6, a joint cover and sealing device 50 is constructed for use in covering and sealing a gap 52 defined between opposing surfaces 54 of two concrete panels 56 and 58 having corresponding outer surfaces 59 forming an outside corner. The device Signed and Sealed this Twelfth Day of March, 2002

*Attest:*

*Attesting Officer*

JAMES E. ROGAN
*Director of the United States Patent and Trademark Office*